US007527025B2

(12) United States Patent
Kadota et al.

(10) Patent No.: US 7,527,025 B2
(45) Date of Patent: May 5, 2009

(54) INTERNAL COMBUSTION ENGINE VARIABLE COMPRESSION RATIO SYSTEM

(75) Inventors: Mitsuo Kadota, Wako (JP); Kensaku Yamamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/822,744

(22) Filed: Jul. 9, 2007

(65) Prior Publication Data

US 2008/0006230 A1 Jan. 10, 2008

(30) Foreign Application Priority Data

Jul. 10, 2006 (JP) ..... 2006-189447

(51) Int. Cl.
*F02B 75/04* (2006.01)

(52) U.S. Cl. ..... 123/48 R; 123/78 B

(58) Field of Classification Search ..... 123/48 A, 123/48 AA, 48 B, 78 A, 78 AA, 78 B, 78 BA, 123/78 E, 78 F, 197.2, 197.4
See application file for complete search history.

(56) References Cited

U.S. PATENT DOCUMENTS 6,915,766 B2 * 7/2005 Aoyama et al. ..... 123/78 E
6,990,934 B2 * 1/2006 Sugiyama et al. ..... 123/48 B

FOREIGN PATENT DOCUMENTS

| | | | |
|---|---|---|---|
| JP | 60-142020 A | | 7/1985 |
| JP | 64-15438 A | | 1/1989 |
| JP | 2-163429 | * | 6/1990 |
| JP | 9-228858 A | | 9/1997 |
| JP | 2003-90236 | * | 3/2003 |
| JP | 2004-92639 | * | 3/2004 |
| JP | 2005-9366 | * | 1/2005 |
| JP | 2005-54619 A | | 3/2005 |

* cited by examiner

*Primary Examiner*—Hai H Huynh
(74) *Attorney, Agent, or Firm*—Birch, Stewart, Kolasch & Birch, LLP

(57) ABSTRACT

In an internal combustion engine variable compression ratio system, a compression ratio of an internal combustion engine is changed over between a high compression ratio and a low compression ratio with a changeover threshold value corresponding to a predetermined operational condition of the internal combustion engine being a boundary. When the internal combustion engine enters a slow acceleration state or a slow deceleration state, a changeover is performed first and then the state is maintained for a predetermined period by prohibiting re-changeover. Therefore, changeover hunting can be prevented in the system while maintaining an appropriate compression ratio in conformity with traveling characteristics demanded by a driver, when the internal combustion engine in a state of slow acceleration or slow deceleration.

9 Claims, 14 Drawing Sheets

HIGH COMPRESSION RATIO
$16_1a$
$17_1a$
$16_1$
$17_1(B)$
$15_1$
5b(H)
$S_1$
5a
$17_2(D)$
$16_2$
$15_2$
$S_1>S_2$
$(S_1+S_2=CONSTANT)$
$S_2$
18
$16_2a$
$17_2a$ $16_1a$
5b(H)
$17_1(A)$
5a
$17_1a$
INERTIAL FORCE
$17_2(D)$
$16_2a$
$17_2a$ $16_1a$
5b(L)
$17_1(A)$
5a
$17_1a$
INERTIAL FORCE
$17_2(D)$
$16_2a$
$17_2a$

LOW COMPRESSION RATIO
$16_1a$
5b(L)
$17_1(A)$
5a
$17_1a$
$S_1$
$S_1<S_2$
$S_2$
$17_2(C)$
$16_2a$
$17_2a$

LOW COMPRESSION RATIO

HIGH COMPRESSION RATIO

CHANGEOVER THRESHOLD VALUE CALCULATION MAP 54

CHANGEOVER APPROXIMATE TIME REQUIRED CALCULATION MAP 55

CHANGEOVER THRESHOLD VALUE RESIDENCE TIME CALCULATION MAP 56

INTERNAL COMBUSTION ENGINE VARIABLE COMPRESSION RATIO SYSTEM

BACKGROUND OF THE INVENTION

1. Field of the Invention

The present invention relates to an improvement of an internal combustion engine variable compression ratio system, in which a compression ratio of an internal combustion engine is changed over between a high compression ratio and a low compression ratio with a changeover threshold value corresponding to a predetermined operational condition of the internal combustion engine being a boundary.

2. Description of the Related Art

Japanese Patent Application Laid-open Nos. 2005-54619, 64-15438, 9-228858, and 60-142020 disclose various types of an internal combustion engine variable compression ratio system which enhances combustion efficiency to increase output and reduce fuel consumption by changing over the compression ratio of the internal combustion engine corresponding to the operational condition, while avoiding abnormal combustion such as knocking.

Also, in the variable compression ratio system disclosed in Japanese Patent Application Laid-open No. 64-15438, in the case where changeover hunting is predicted in the system when the system enters a state in which the operational condition of the internal combustion engine frequently crosses the changeover threshold value (mainly caused by load fluctuations), such as in the case of slow acceleration or deceleration, changeover is prohibited for a certain period of time so as to hold the compression ratio before the occurrence of changeover hunting, whereby the durability of the system is secured.

However, the variable compression ratio system which avoids the changeover hunting by prohibiting the changeover for a certain period of time to maintain the compression ratio before the occurrence of changeover hunting when the changeover hunting is predicted as described above, cannot maintain a compression ratio appropriately corresponding to traveling characteristics demanded by the driver. Therefore, improvement in drivability, output, and mileage is not satisfactory.

SUMMARY OF THE INVENTION

The present invention has been achieved in view of the above circumstances. An object of the present invention is to provide an internal combustion engine variable compression ratio system capable of avoiding changeover hunting in the system while maintaining an appropriate compression ratio in conformity with traveling characteristics demanded by a driver, when an internal combustion engine is in a state of slow acceleration or slow deceleration.

In order to achieve the above object, according to a first feature of the present invention, there is provided an internal combustion engine variable compression ratio system, in which a compression ratio of an internal combustion engine is changed over between a high compression ratio and a low compression ratio with a changeover threshold value corresponding to a predetermined operational condition of the internal combustion engine being a boundary, wherein the system comprises means for holding a changed-over state for a predetermined period of time after a first changeover of compression ratio is performed when the internal combustion engine enters a slow acceleration or deceleration state.

With the first feature of the present invention, when the internal combustion engine enters the slow acceleration or deceleration state, the changeover of compression ratio is performed first and the changed-over state is held for a predetermined period of time, thereby preventing changeover hunting of the system while maintaining the appropriate compression ratio demanded by the driver. Therefore, not only the drivability can be improved, but also an increased engine output and reduced fuel consumption can be achieved, and at the same time, durability of the variable compression ratio system can be enhanced.

According to a second feature of the present invention, in addition to the first feature, the first changeover of compression ratio is performed after changeover approximate time required of the variable compression ratio system has elapsed from the time when the operational condition of the internal combustion engine reaches the changeover threshold value.

With the second feature of the present invention, the compression ratio of the internal compression engine can reliably corresponds to the compression ratio of changeover command.

According to a third feature of the present invention, in addition to the second feature, the predetermined period of time for which a changed-over state is held after the first changeover of compression ratio is performed is set to be residence time or less in the vicinity of the changeover threshold value of the operational condition of the internal combustion engine.

With the third feature of the present invention, after the first changeover of compression ratio, the timing to change the compression ratio over to the next appropriate compression ration cannot be lost.

According to a fourth feature of the present invention, in addition to the third feature, the residence time is calculated based on the operational condition of the internal combustion engine.

With the fourth feature of the present invention, the calculated residence time can be brought as close as possible to the actual residence time by calculating the residence time based on the operational condition of the internal combustion engine.

According to a fifth feature of the present invention, in addition to any of the first to fourth features, the changeover threshold value is set based on at least the throttle opening degree in the internal combustion engine.

With the fifth feature of the present invention, the changeover threshold value can correspond to the torque of the internal combustion engine by calculating the changeover threshold value based on at least the throttle opening degree in the internal combustion engine, and also the accuracy of calculation of the changeover value can be improved.

The above-mentioned object, other objects, characteristics, and advantages of the present invention will become apparent from a preferred embodiment, which will be described in detail below by reference to the attached drawings.

DESCRIPTION OF THE PREFERRED EMBODIMENT

First, the basic structure of a variable compression ratio system of an internal compression engine E is described with reference to FIGS. 1 to 9.

Figure 1:
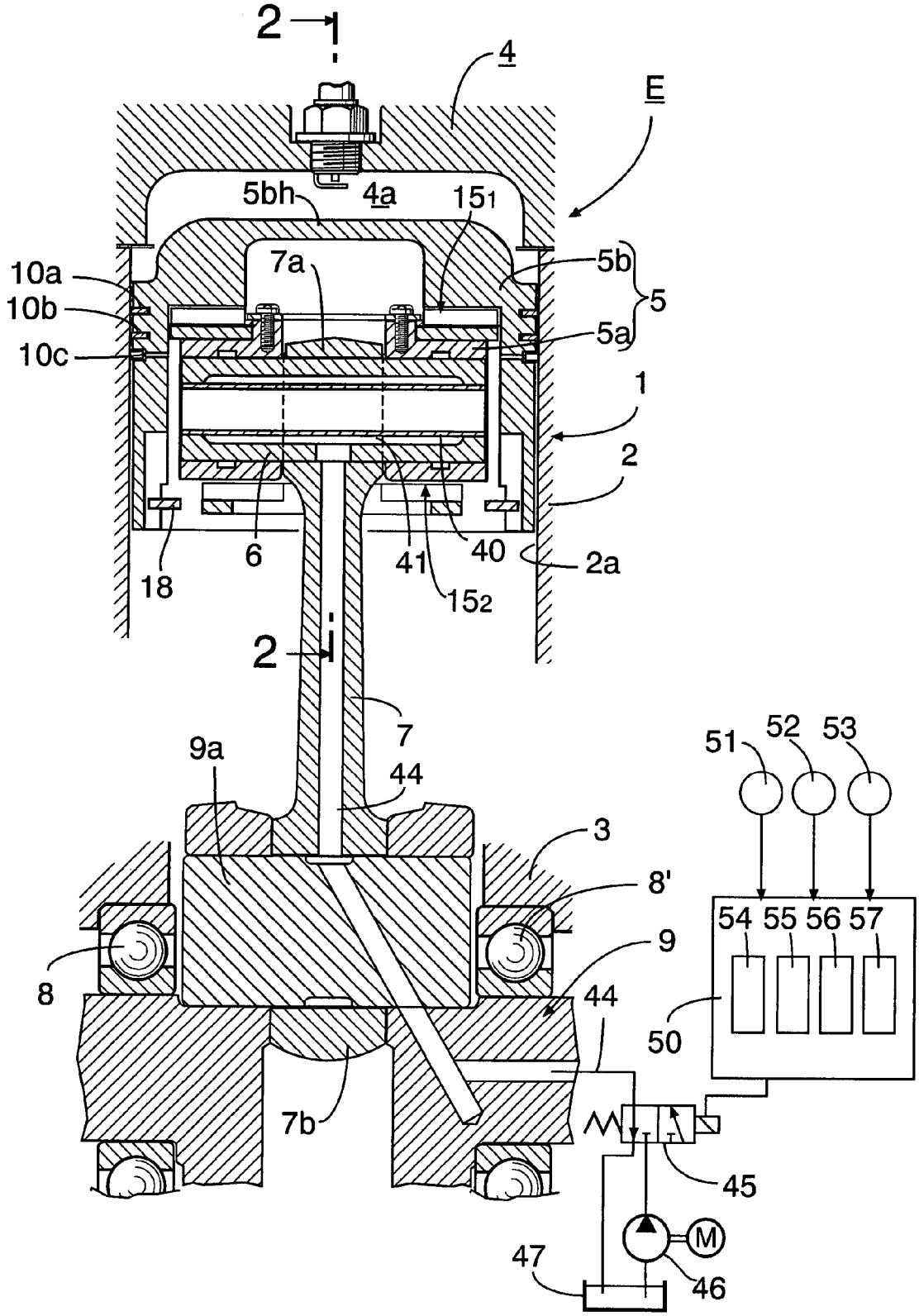
FIG. 1 is a longitudinally sectional front view of an essential part of an internal combustion engine provided with a variable compression ratio system according to an embodiment of the present invention.
Figure 2:
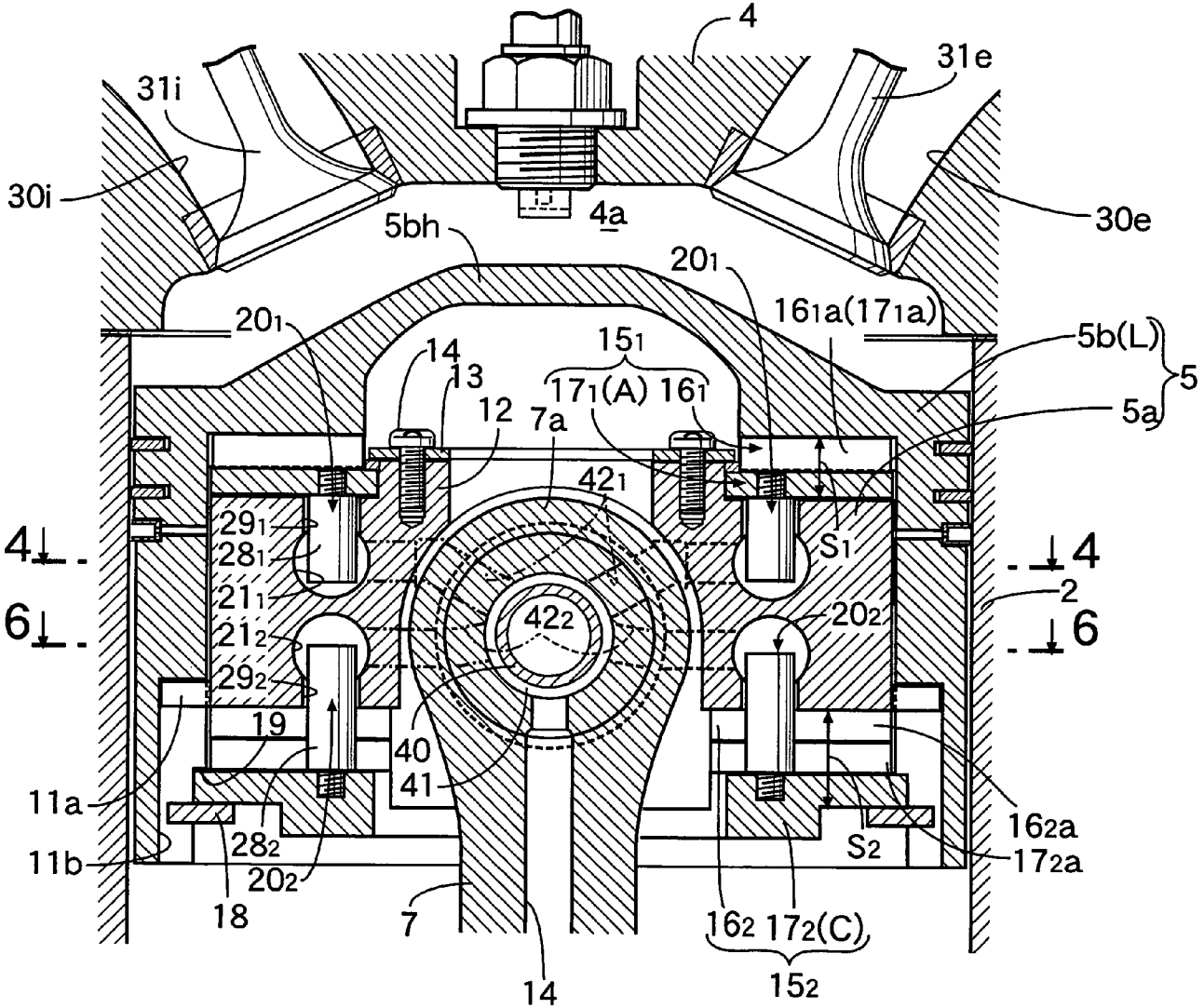
FIG. 2 is an enlarged sectional view taken along line 2-2 in FIG. 1, showing a high compression ratio state.
Figure 3:
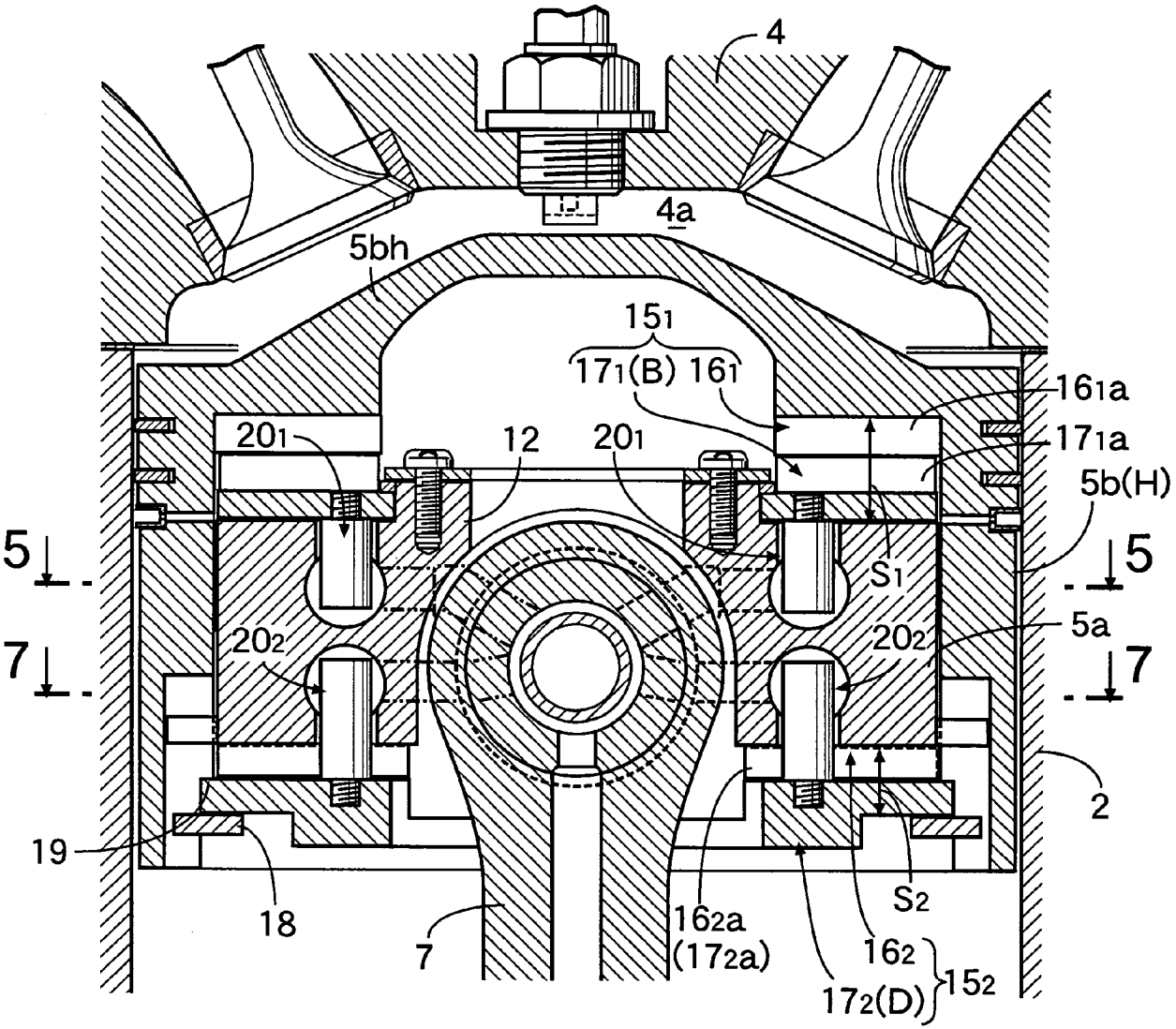
FIG. 3 is a view, corresponding to FIG. 2, showing a high compression ratio state.

Referring to FIGS. 1 to 3, in the internal compression engine E, a piston 5 moving up and down in a cylinder bore 2*a* of a cylinder block 2 is connected via a connecting rod 7 to a crankshaft 9 rotatably supported in a crankcase 3 via bearings 8 and 8'. The piston 5 comprises an inner piston 5*a* and an outer piston 5*b*. The inner piston 5*a* is connected to a small end 7*a* of the connecting rod 7 via a piston pin 6. The outer piston 5*b* slidably engages with the outer peripheral surface of the inner piston 5*a* so as to be movable on the inner piston 5*a* between a predetermined low compression ratio position L (see FIG. 2) and a high compression ratio position H (see FIG. 3). The outer piston 5*b* slidably engages with the inner peripheral surface of the cylinder bore 2*a* via a plurality of piston rings 10*a* to 10*c* mounted around the outer periphery of the outer piston 5*b*, and causes a head portion 5*bh* to face a combustion chamber 4*a* of a cylinder head 4.

A plurality of spline teeth 11*a* and spline grooves 11*b* extending in the axial direction of the piston 5 and engaging with each other are formed on the sliding mating faces of the inner piston and outer 5*a* and 5*b* respectively, thereby preventing relative rotation of the inner piston and outer 5*a* and 5*b* around their axes. Further, a retaining ring 18 for restricting axial movement of the inner piston 5*a* relative to the outer piston 5*b* is latched to an inner peripheral face of the outer piston 5*b* so that the inner piston 5*a* is interposed between the retaining ring 18 and, on the opposite side, the head portion 5*bh*.

A first cam mechanism $\mathbf{15}_1$ is disposed between the inner piston 5*a* and the head portion 5*bh* so as to control a first axial spacing $S_1$ therebetween, and a second cam mechanism $\mathbf{15}_2$ is disposed between the inner piston 5*a* and the retaining ring 18 so as to control a second axial spacing $S_2$ therebetween. Increasing and decreasing the first and second axial spacings $S_1$ and $S_2$ oppositely to each other by means of these first and second cam mechanisms $\mathbf{15}_1$ and $\mathbf{15}_2$ enables the outer piston 5*b* to be held alternately at the low compression ratio position L, which is close to the piston pin relative to the inner piston 5*a*, and at the high compression ratio position H, which is close to the combustion chamber 4*a* relative to the inner piston 5*a*.

Figure 6:
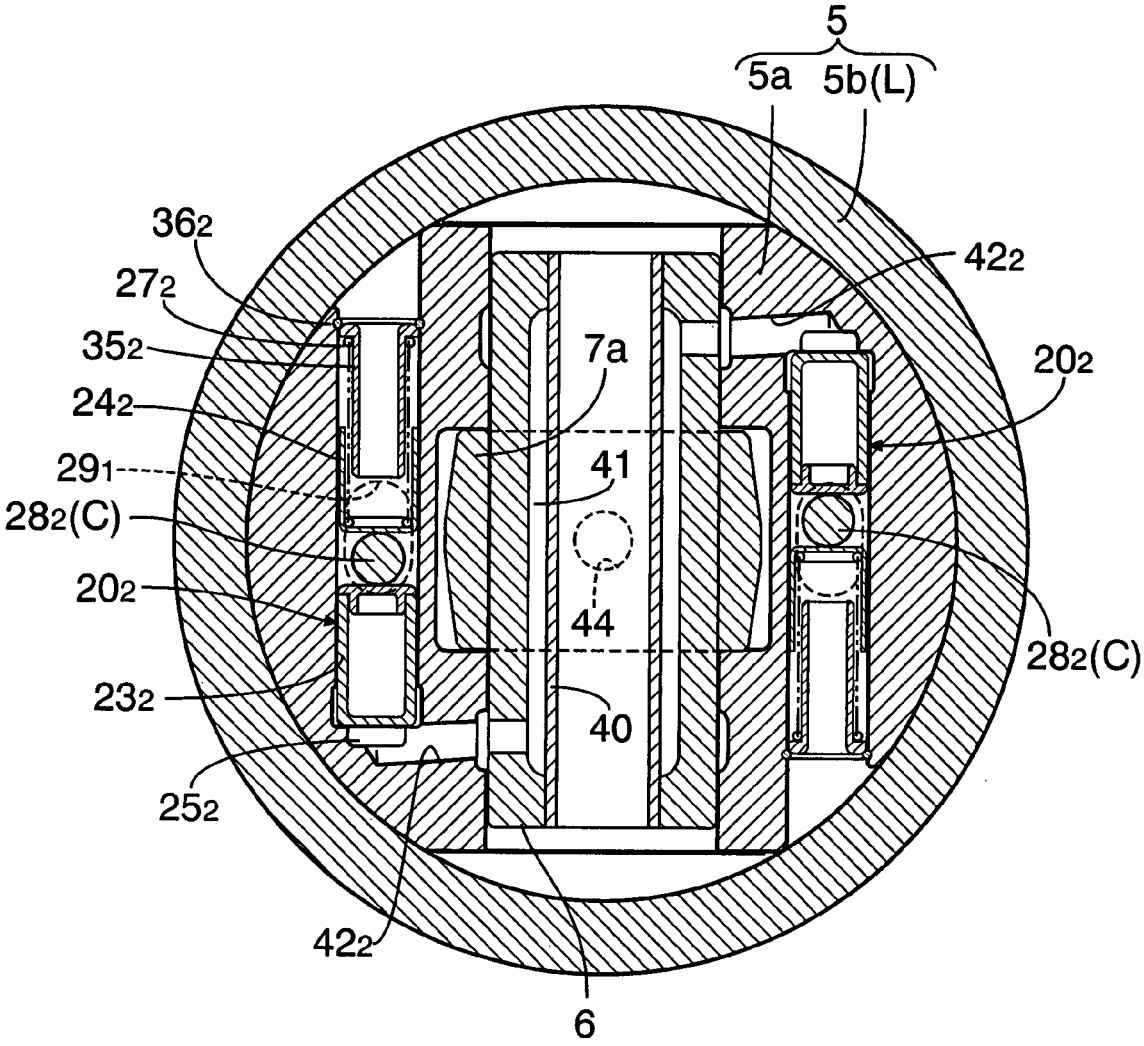
FIG. 6 is a sectional view taken along line 6-6 in FIG. 2.
Figure 7:
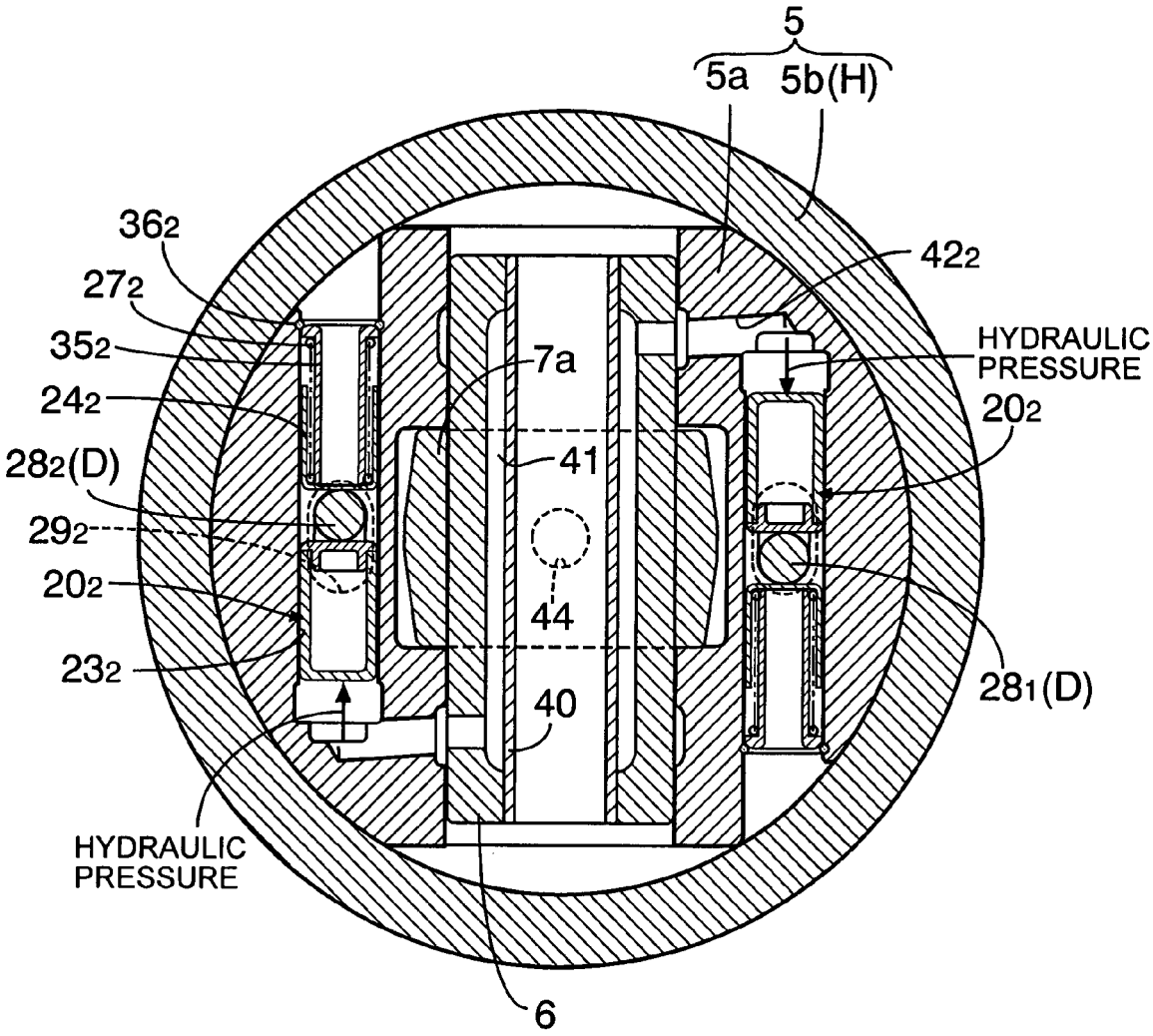
FIG. 7 is a sectional view taken along line 7-7 in FIG. 3.

In FIG. 2, FIG. 3, and FIG. 6, the first cam mechanism $\mathbf{15}_1$ includes an upper first fixed cam $\mathbf{16}_1$ and a lower first rotating cam plate $\mathbf{17}_1$ the first fixed cam $\mathbf{16}_1$ being formed on an inner wall of the head portion 5*bh* of the outer piston 5*b*, and the first rotating cam plate $\mathbf{17}_1$ being supported on an upper face of the inner piston 5*a* while being pivotably fitted around a pivot portion 12 integrally and projectingly provided on the upper face of the inner piston 5*a*.

The first rotating cam plate $\mathbf{17}_1$ is capable of rotating between first and second rotational positions A and B set around the axis thereof, and its reciprocating rotation, in cooperation with the first fixed cam $\mathbf{16}_1$, increases and decreases the first axial spacing $S_1$. Specifically, the first fixed cam $\mathbf{16}_1$ includes a plurality of cam peaks $\mathbf{16}_1a$ arranged in the peripheral direction, and similarly the first rotating cam plate $\mathbf{17}_1$ is provided integrally with a plurality of cam peaks $\mathbf{17}_1a$ arranged in the peripheral direction.

When the first rotating cam plate $\mathbf{17}_1$ is at the first rotational position A, the cam peak $\mathbf{16}_1a$ of the upper first fixed cam $\mathbf{16}_1$ can go in and out of a valley between adjacent cam peaks $\mathbf{17}_1a$ of the first rotating cam plate $\mathbf{17}_1$ (see FIGS. 8A and 8B), and as a result movement of the outer piston 5*b* to the low compression ratio position L or the high compression ratio position H is allowed. When the upper and lower cam peaks $\mathbf{16}_1a$ and $\mathbf{17}_1a$ mesh with each other, the first cam mechanism $\mathbf{15}_1$ is in an axially compressed state, thus decreasing the first axial spacing $S_1$.

On the other hand, when the first rotating cam plate $\mathbf{17}_1$ is at the second rotational position B, the flat tops of the cam peaks $\mathbf{16}_1a$ and $\mathbf{17}_1a$ of the first fixed cam $\mathbf{16}_1$ and the first rotating cam plate $\mathbf{17}_1$ abut against each other (see FIG. 8A), and the first cam mechanism $\mathbf{15}_1$ is thus in an axially expanded state, thereby increasing the first axial spacing $S_1$ and holding the outer piston 5*b* at the high compression ratio position H.

Provided between the inner piston 5*a* and the first rotating cam plate $\mathbf{17}_1$ is a first actuator $\mathbf{20}_1$ for rotating the first rotating cam plate $\mathbf{17}_1$ alternately to the first rotational position A and the second rotational position B.

Figure 4:
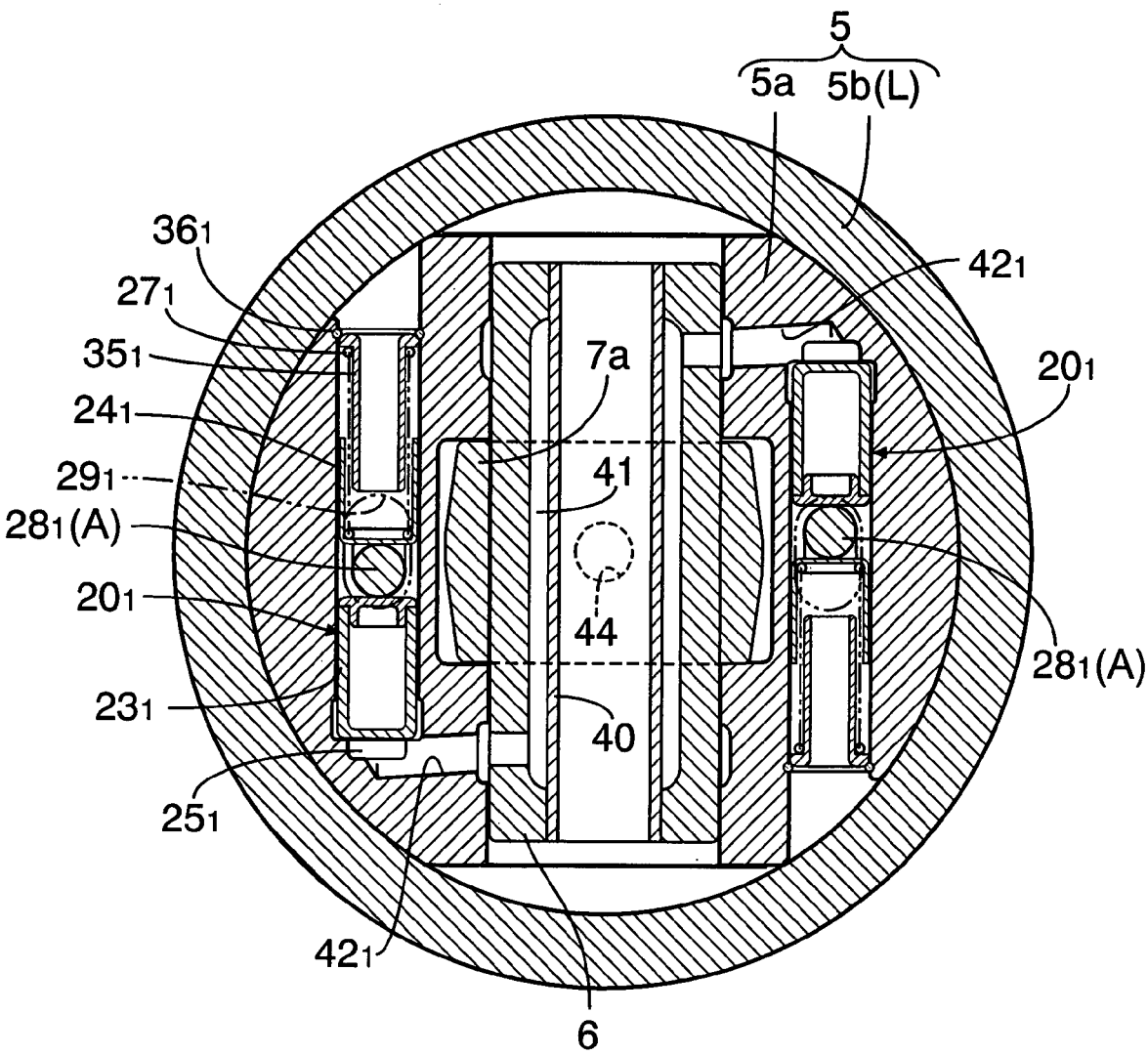
FIG. 4 is a sectional view taken along line 4-4 in FIG. 2.

The first actuator $\mathbf{20}_1$ has a structure as shown in FIG. 2 and FIG. 4. Specifically, the inner piston 5*a* is provided with a pair of bottomed cylinder holes $\mathbf{21}_1$ extending parallel to the piston pin 6 on either side thereof, and long holes $\mathbf{29}_1$ running through an upper wall of a middle section of each of the cylinder holes $\mathbf{21}_1$. A pair of pressure-receiving pins $\mathbf{28}_1$ projectingly provided integrally with a lower face of the first rotating cam plate $\mathbf{17}_1$ and arranged on a diameter thereof run through the long holes $\mathbf{29}_1$, face the cylinder holes $\mathbf{21}_1$. The long holes $\mathbf{29}_1$ are arranged so that the pressure-receiving pins $\mathbf{28}_1$ are not prevented from moving together with the first rotating cam plate $\mathbf{17}_1$ between the first rotational position A and the second rotational position B.

An operating plunger $\mathbf{23}_1$ and a bottomed cylindrical return plunger $\mathbf{24}_1$ are fitted slidably in each of the cylinder holes $\mathbf{21}_1$ with the corresponding pressure-receiving pin $\mathbf{28}_1$ interposed therebetween. In this arrangement, the operating plungers $\mathbf{23}_1$ and the return plungers $\mathbf{24}_1$ are each disposed point-symmetrically relative to the axis of the piston 5.

A first hydraulic chamber $\mathbf{25}_1$ is defined within each of the cylinder holes $\mathbf{21}_1$, the inner end of the operating plunger $\mathbf{23}_1$ facing the first hydraulic chamber $\mathbf{25}_1$. When hydraulic pressure is supplied to the chamber $\mathbf{25}_1$ the operating plunger $\mathbf{23}_1$ receives the hydraulic pressure and rotates the first rotating cam plate $\mathbf{17}_1$ to the second rotational position B via the pressure-receiving pin $\mathbf{28}_1$.

Moreover, a cylindrical spring retaining tube $\mathbf{35}_1$ is latched at an end portion on the open side of each of the cylinder holes $21_1$ via a retaining ring $36_1$, and a return spring $27_1$ is provided under compression between the spring retaining tube $35_1$ and the return plunger $24_1$, the return spring $27_1$ urging the return plunger $24_1$ toward the pressure-receiving pin $28_1$.

In this way, the first rotational position A of the first rotating cam plate $17_1$ is defined by each of the pressure-receiving pins $28_1$ abutting against the extremity of the operating plunger $23_1$, which abuts against the bottom face of the cylinder hole $21_1$, and the second rotational position B of the first rotating cam plate $17_1$ is defined by the return plunger $24_1$, which is pushed by the pressure-receiving pin $28_1$, abutting against the extremity of the spring retaining tube $35_1$.

In FIG. 2, FIG. 3, and FIG. 6, the second cam mechanism $15_2$ includes an upper second fixed cam $16_2$ and a lower second rotating cam plate $17_2$, the second fixed cam $16_2$ being formed on a lower end wall of the inner piston 5*a*, and the second rotating cam plate $17_2$ being rotatably fitted to an inner peripheral face of the outer piston 5*b* above the retaining ring 18. An annular shoulder 19 is formed on the inner periphery of the outer piston 5*b*, the shoulder 19 abutting against an upper face of the second rotating cam plate $17_2$, and this shoulder 19 and the retaining ring 18 hold the second rotating cam plate $17_2$ so that it can rotate but is prevented from axially moving relative to the outer piston 5*b*.

The second rotating cam plate $17_2$ is capable of rotating between a third rotational position C and a fourth rotational position D set around the axis thereof, and its reciprocating rotation, in cooperation with the second fixed cam $16_2$, increases and decreases the second axial spacing $S_2$. Specifically, the second fixed cam $16_2$ includes a plurality of cam peaks $16_2a$ arranged in the peripheral direction, and similarly the second rotating cam plate $17_2$ is integrally provided with a plurality of cam peaks $17_2a$ arranged in the peripheral direction.

The rotational angle between the third and fourth rotational positions C and D of the second rotating cam plate $17_2$ is set so as to be identical to the rotational angle between the first and second rotational positions A and B of the first rotating cam plate $17_1$. Furthermore, at least the effective heights of the cam peaks $16_2a$ and $17_2a$ of the second fixed cam $16_2$ and the second rotating cam plate $17_2$ are set so as to be identical to those of the cam peaks $16_1a$ and $17_1a$ of the first fixed cam $16_1$ and the first rotating cam plate $17_1$.

When the second rotating cam plate $17_2$ is at the third rotational position C, the flat top faces of the cam peaks $16_2a$ and $17_2a$ of the second fixed cam $16_2$ and the second rotating cam plate $17_2$ abut against each other (see FIG. 8D), so that the second cam mechanism $15_2$ is in an axially expanded state, thus increasing the second axial spacing $S_2$ and holding the outer piston 5*b* at the low compression ratio position L.

When the second rotating cam plate $17_2$ is at the fourth rotational position D, the cam peak $16_2a$ of the second fixed cam $16_2$ can go in and out of a valley between adjacent cam peaks $17_2a$ of the second rotating cam plate $17_2$ (see FIGS. 8A and 8C), and as a result movement of the outer piston 5*b* to the low compression ratio position L or the high compression ratio position H is allowed. When the upper and lower cam peaks $16_2a$ and $17_2a$ mesh with each other, the second cam mechanism $15_2$ is in an axially compressed state, thus decreasing the second axial spacing $S_2$.

Provided between the inner piston 5*a* and the second rotating cam plate $17_2$ is a second actuator $20_2$ for rotating the second rotating cam plate $17_2$ alternately to the third rotational position C and the fourth rotational position D.

The first actuator $20_2$ has a structure as shown in FIG. 2 and FIG. 6. Specifically, the structures of the second actuator $20_2$ and the first actuator $20_1$ are symmetrical. That is, the inner piston 5*a* is provided with a pair of bottomed cylinder holes $21_2$ extending parallel to the piston pin 6 on either side thereof, and long holes $29_2$ running through an upper wall of a middle section of the cylinder holes $21_2$. A pair of pressure-receiving pins $28_2$ projectingly provided integrally with a lower face of the second rotating cam plate $17_2$ and arranged on a diameter thereof run through the long holes $29_2$, face the cylinder holes $21_2$. The long holes $29_2$ are arranged so that the pressure-receiving pins $28_2$ are not prevented from moving together with the second rotating cam plate $17_2$ between the third rotational position C and the fourth rotational position D.

An operating plunger $23_2$ and a bottomed cylindrical return plunger $24_2$ are fitted slidably in each of the cylinder holes $21_2$ with the corresponding pressure-receiving pin $28_2$ interposed therebetween. In this arrangement, the operating plungers $23_2$ and the return plungers $24_2$ are each disposed point-symmetrically relative to the axis of the piston 5.

A second hydraulic chamber $25_2$ is defined within each of the cylinder holes $21_2$, the inner end of the operating plunger $23_2$ facing the second hydraulic chamber $25_2$. When hydraulic pressure is supplied to the chamber $25_2$ the operating plunger $23_2$ receives the hydraulic pressure and pivots the second rotating cam plate $17_2$ to the fourth rotational position D via the pressure-receiving pin $28_2$.

Moreover, a cylindrical spring retaining tube $35_2$ is latched at an end portion on the open side of each of the cylinder holes $21_2$ via a retaining ring $36_2$, and a return spring $27_2$ is provided under compression between the spring retaining tube $35_2$ and the return plunger $24_2$, the return spring $27_2$ urging the return plunger $24_2$ toward the pressure-receiving pin $28_2$. In this way, the second actuator $20_2$ is structured symmetrically with the first actuator $20_1$.

In this way, the third rotational position C of the second rotating cam plate $17_2$ is defined by each of the pressure-receiving pins $28_2$ abutting against the extremity of the operating plunger $23_2$, which abuts against the bottom face of the cylinder hole $21_2$, and the fourth rotational position D of the second rotating cam plate $17_2$ is defined by the return plunger $24_2$, which is pushed by the pressure-receiving pin $28_2$, abutting against the extremity of the spring retaining tube $35_2$.

In the above-mentioned arrangement, the first rotating cam plate $17_1$ and the first actuator $20_1$, and the second rotating cam plate $17_2$ and the second actuator $20_2$ allow the outer piston 5*b* to move between the low compression ratio position L and the high compression ratio position H by virtue of an external force that makes the inner piston and outer 5*a* and 5*b* move toward or away from each other in the axial direction, such as a difference in inertial force between the inner piston 5*a* and the outer piston 5*b*, the frictional resistance between the outer piston 5*b* and the inner face of the cylinder bore 2*a*, or negative or positive pressure acting on the outer piston 5*b* from the combustion chamber 4*a* side.

Referring again to FIG. 1 and FIG. 2, a tubular oil chamber 41 is defined between the piston pin 6 and a sleeve 40 press-fitted in a hollow portion of the piston pin 6, and first and second oil distribution passages $42_1$ and $42_2$ providing a connection between the oil chamber 41 and the hydraulic chambers $25_1$ and $25_2$ of the first and second actuators $20_1$ and $20_2$ are provided across the piston pin 6 and the inner piston 5*a*. The oil chamber 41 is connected to an oil passage 44 that is provided across the piston pin 6, the connecting rod 7, and the crankshaft 9, and this oil passage 44 is switchably connected, via a solenoid control valve 45, to an oil pump 46, which is a hydraulic source, and to an oil reservoir 47.

Figures 8A, 8B, 8C, 8D:
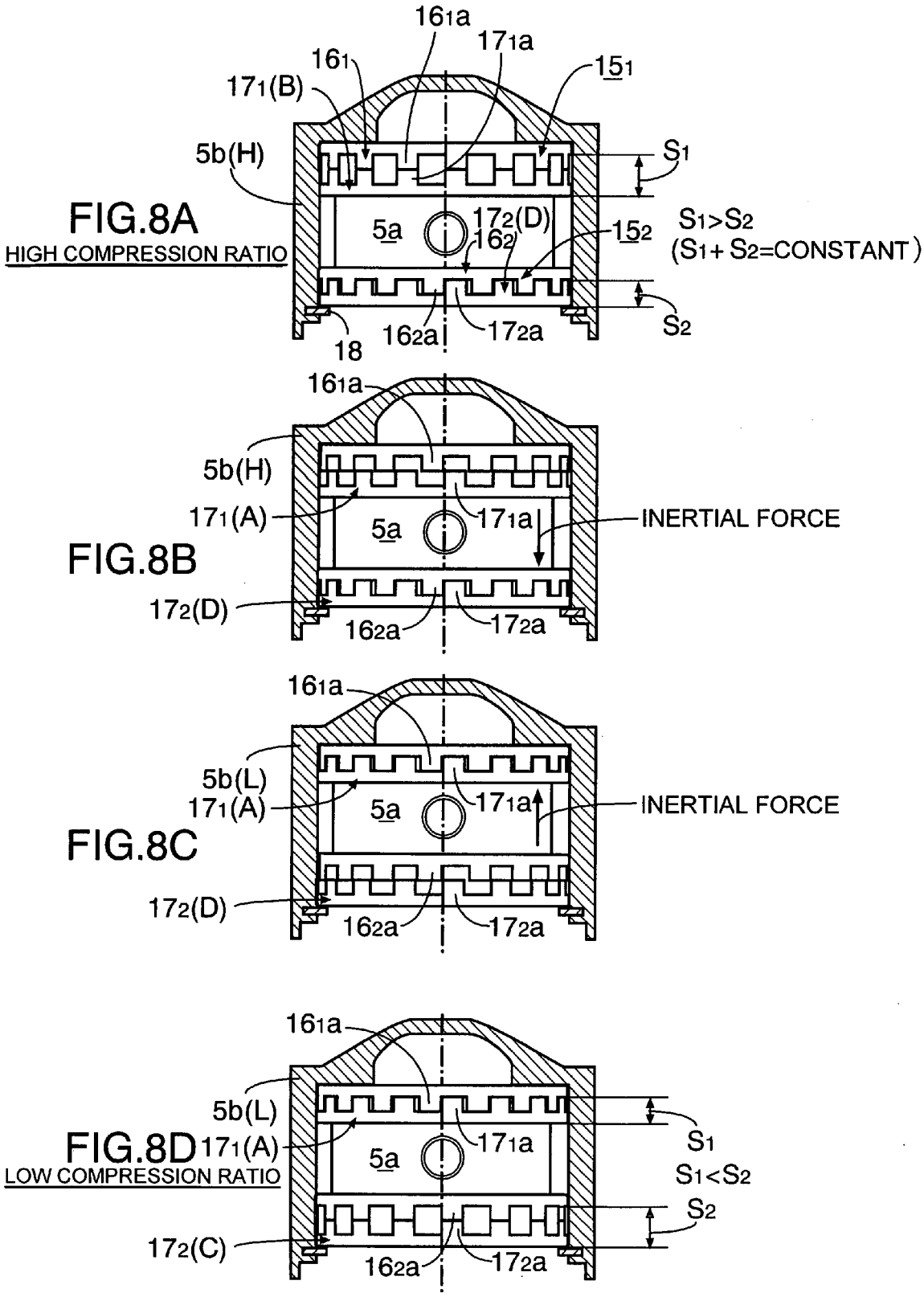
FIGS. 8A to 8D are diagrams for showing an operation of changeover from the high compression ratio state to the low compression ratio state.

Switching From High Compression Ratio Position To Low Compression Ratio Position Assume that, as shown in FIG. 8A, the outer piston 5*b* is held at the high compression ratio position H. That is, in the first cam mechanism $\mathbf{15}_1$ the upper and lower cam peaks $\mathbf{16}_1a$ and $\mathbf{17}_1a$ are in the axially expanded state in which top faces thereof are facing each other, and in the second cam mechanism $\mathbf{15}_2$ the upper and lower cam peaks $\mathbf{16}_2a$ and $\mathbf{17}_2a$ are in the axially compressed state in which they are meshed with each other.

In this state, if the solenoid control valve 45 is put in a non-energized state as shown in FIG. 1 to open the oil passage 44 to the oil reservoir 47, the hydraulic chambers $\mathbf{25}_1$ and $\mathbf{25}_2$ of the first and second actuators $\mathbf{20}_1$ and $\mathbf{20}_2$ are both opened to the oil reservoir 47 via the oil chamber 41 and the oil passage 44. Therefore, in the first actuator $\mathbf{20}_1$ the return plunger $\mathbf{24}_1$ pushes the pressure-receiving pin $\mathbf{28}_1$ by virtue of the urging force of the return spring $\mathbf{27}_1$ so as to rotate the first rotating cam plate $\mathbf{17}_1$ to the first rotational position A; and in the second actuator $\mathbf{20}_1$ the return plunger $\mathbf{24}_2$ pushes the pressure-receiving pin $\mathbf{28}_2$ by virtue of the urging force of the return spring $\mathbf{27}_2$ so as to rotate the second rotating cam plate $\mathbf{17}_2$ to the third rotational position C.

When the piston 5 proceeds to the intake stroke, a downward inertial force acts on the inner piston 5*a* prior to acting on the outer piston 5*b*, and thus the first cam mechanism $\mathbf{15}_1$ is released from the thrust load between the inner piston 5*a* and the outer piston 5*b*. Therefore, the first rotating cam plate $\mathbf{17}_1$ is first quickly rotated to the first rotational position A via the pressure-receiving pin $\mathbf{28}_1$ by virtue of the urging force of the return spring $\mathbf{27}_1$ of the first actuator $\mathbf{20}_1$. As a result, as shown in FIG. 8B, the upper and lower cam peaks $\mathbf{16}_1a$ and $\mathbf{17}_1a$ of the first cam mechanism $\mathbf{15}_1$ are in a configuration in which they are displaced from each other by half the pitch and can mesh with each other.

Subsequently, when the piston 5 comes to the second half of the compression stroke, an upward inertial force acts on the inner piston 5*a* prior to acting on the outer piston 5*b*, so that the outer piston 5*b* descends relative to the inner piston 5*a* as shown in FIG. 8C while making the upper and lower cam peaks $\mathbf{16}_1a$ and $\mathbf{17}_1a$ of the first cam mechanism $\mathbf{15}_1$ mesh with each other, that is, while making the first cam mechanism $\mathbf{15}_1$ compress in the axial direction, thus occupying the low compression ratio position L.

In this way, when the outer piston 5*b* descends relative to the inner piston 5*a*, in the second cam mechanism $\mathbf{15}_2$ the second rotating cam plate $\mathbf{17}_2$ descends relative to the second fixed cam $\mathbf{16}_2$, the upper and lower cam peaks $\mathbf{16}_2a$ and $\mathbf{17}_2a$ are accordingly released from the meshed state, and the second rotating cam plate $\mathbf{17}_2$ is therefore quickly rotated to the third rotational position C via the pressure-receiving pin $\mathbf{28}_2$ by virtue of the urging force of the return spring $\mathbf{27}_2$ of the second actuator $\mathbf{20}_2$. As a result, as shown in FIG. 8D, the flat top faces of the upper and lower cam peaks $\mathbf{16}_2a$ and $\mathbf{17}_2a$ of the second cam mechanism $\mathbf{15}_2$ are made to abut against each other. Due to this kind of axial expansion of the second cam mechanism $\mathbf{15}_2$ the second axial spacing $S_2$ increases, thereby holding the outer piston 5*b* at the low compression ratio position L to put the internal combustion engine E in a low compression ratio state.

Switching From Low Compression Ratio Position To High Compression Ratio Position Subsequently, when the internal combustion engine E is being operated at high speed, the solenoid control valve 45 is put in an energized state, thus connecting the oil passage 44 to the oil pump 46. Since hydraulic pressure discharged from the oil pump 46 is supplied to all the hydraulic chambers $\mathbf{25}_1$ and $\mathbf{25}_2$ via the oil passage 44 and the oil chamber 41, in the first actuator $\mathbf{20}_1$ the operating plunger $\mathbf{23}_1$ receives the hydraulic pressure from the first hydraulic chamber $\mathbf{25}_1$ and attempts to rotate the first rotating cam plate $\mathbf{17}_1$ toward the second rotational position B via the pressure-receiving pin $\mathbf{28}_1$; and in the second actuator $\mathbf{20}_2$ the operating plunger $\mathbf{23}_2$ receives the hydraulic pressure from the second hydraulic chamber $\mathbf{25}_2$ and attempts to rotate the second rotating cam plate $\mathbf{17}_2$ toward the fourth rotational position D via the pressure-receiving pin $\mathbf{28}_2$.

Figure 9A:
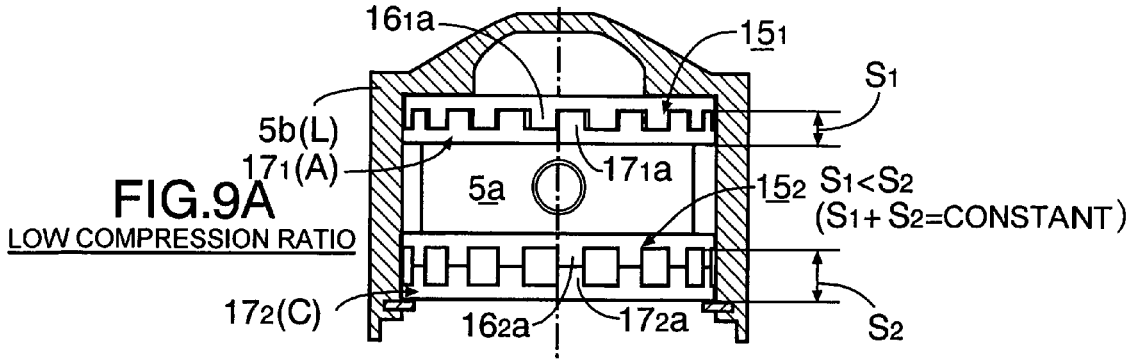
FIGS. 9A to 9D are diagrams showing an operation of changeover from the low compression ratio state to the high compression ratio state.
Figure 9B:
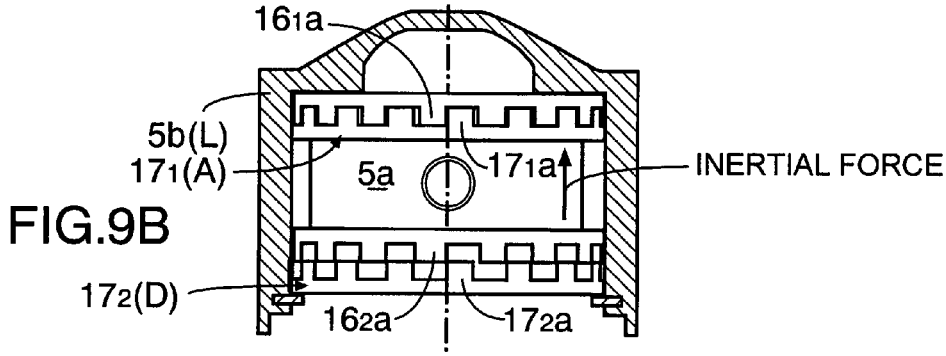

When the piston 5 proceeds to the exhaust stroke, the inner piston 5*a* receives an upward inertial force before the outer piston 5*b* receives it, and the second cam mechanism $\mathbf{15}_2$ disposed between the inner piston 5*a* and the retaining ring 18 is therefore released from the thrust load. The second rotating cam plate $\mathbf{17}_2$ is therefore first quickly rotated to the fourth rotational position D via the pressure-receiving pin $\mathbf{28}_2$ by virtue of the pressing force due to the hydraulic pressure of the operating plunger $\mathbf{23}_2$ of the second actuator $\mathbf{20}_2$. As a result, as shown in FIG. 9B, the upper and lower cam peaks $\mathbf{16}_2a$ and $\mathbf{17}_2a$ of the second cam mechanism $\mathbf{15}_2$ are in a configuration in which they are displaced from each other by half the pitch and can mesh with each other.

Figure 9C:
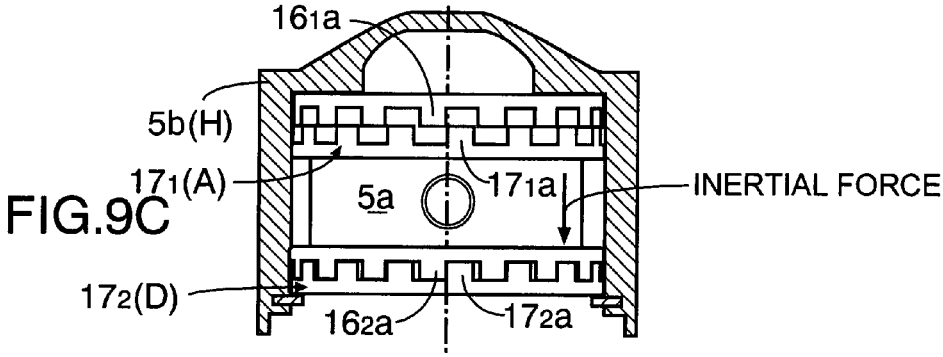
Figure 9D:
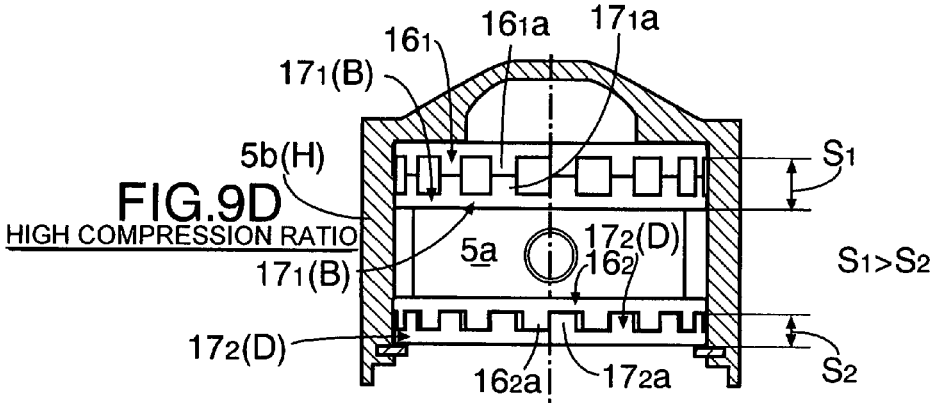

Subsequently, when the piston 5 reaches the second half of the intake stroke, since a downward inertial force acts on the inner piston 5*a* prior to acting on the outer piston 5*b*, the outer piston 5*b* ascends relative to the inner piston 5*a* as shown in FIG. 9C while making the upper and lower cam peaks $\mathbf{16}_2a$ and $\mathbf{17}_2a$ of the second cam mechanism $\mathbf{15}_2$ mesh with each other, that is, while making the second cam mechanism $\mathbf{15}_2$ compress in the axial direction, thus occupying the high compression ratio position H.

Figure 5:
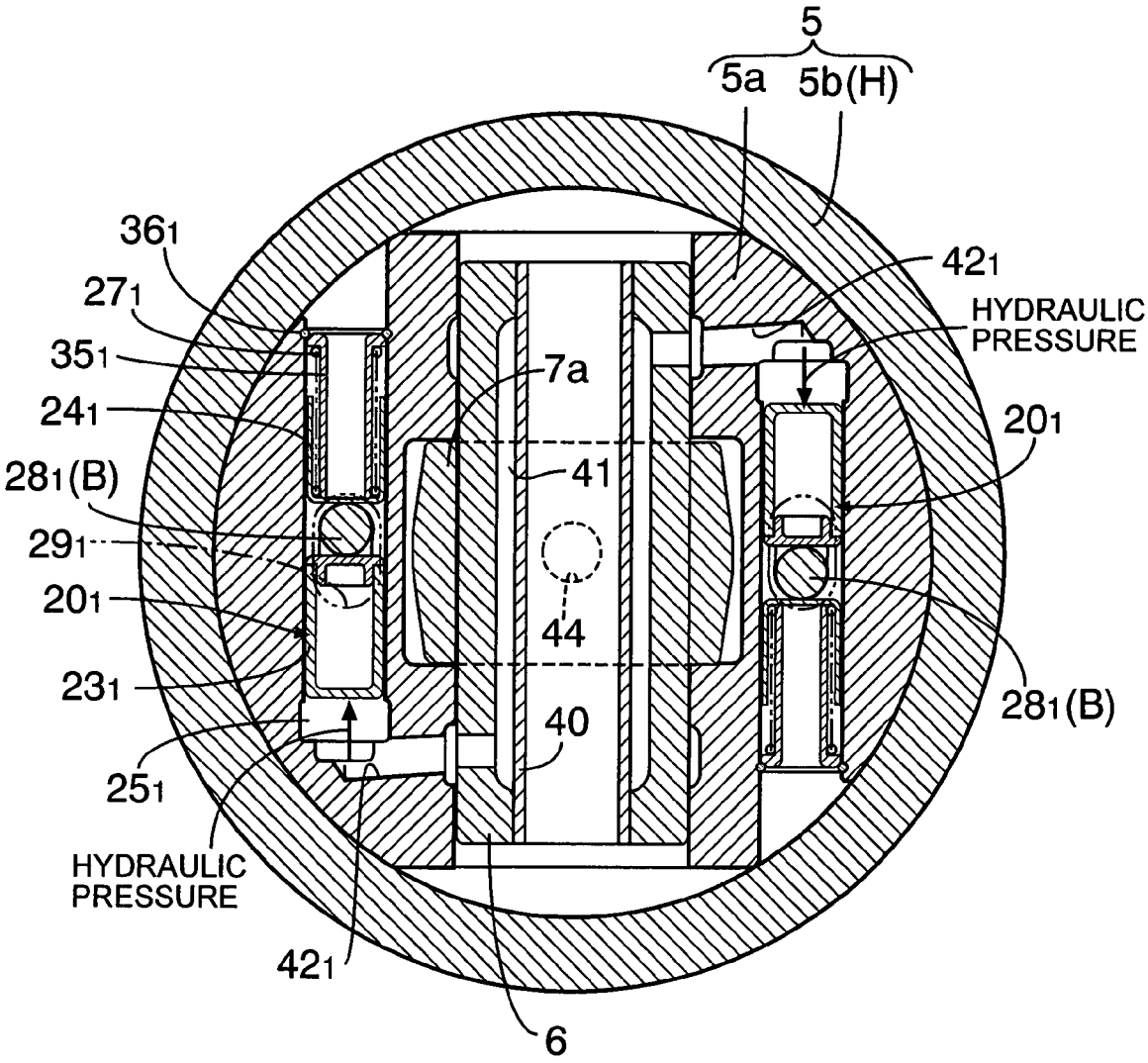
FIG. 5 is an enlarged sectional view taken along line 5-5 in FIG. 3.

In this way, when the outer piston 5*b* ascends relative to the inner piston 5*a*, in the first cam mechanism $\mathbf{15}_1$ the first fixed cam $\mathbf{16}_1$ ascends relative to the first rotating cam plate $\mathbf{17}_1$, the upper and lower cam peaks $\mathbf{16}_1a$ and $\mathbf{17}_1a$ are accordingly released from the meshed state, and the first rotating cam plate $\mathbf{17}_1$ is therefore quickly rotated to the second rotational position B via the pressure-receiving pin $\mathbf{28}_2$ by virtue of the pushing force, due to hydraulic pressure, of the operating plunger $\mathbf{23}_1$ of the first actuator $\mathbf{20}_1$ (see FIG. 5). As a result, as shown in FIG. 8D, the flat top faces of the upper and lower cam peaks $\mathbf{16}_1a$ and $\mathbf{17}_1a$ of the first cam mechanism $\mathbf{15}_1$ are made to abut against each other. Due to this kind of axial expansion of the first cam mechanism $\mathbf{15}_1$, the first axial spacing $S_1$ increases, thereby holding the outer piston 5*b* at the high compression ratio position H. Thus, the internal combustion engine E is put in a high compression ratio state.

The structure of the above-described variable compression ration system basically conforms to that of the system disclosed in Japanese Patent Application Laid-open No. 2005-54619.

As shown in FIG. 1, an electronic control unit 50 for controlling the operation to the solenoid switch valve 45 of the solenoid switch valve 45 is connected. Input to the electronic control unit 50 are output signals from components such as a rotational speed sensor 51 for detecting the rotational speed of the engine E, a throttle sensor 52 for detecting the opening of a throttle valve of the engine E, and a temperature sensor 53 for detecting the temperature (for example, the temperature of cooling water) in the engine E.

Provided in the electronic control unit 50 are a changeover threshold value calculation map 54, a changeover approximate time required calculation map 55, a changeover threshold value residence time calculation map 56, and a counter 57 that starts an operation when the operational condition of the engine E enters the region of a changeover threshold value Ti.

Figure 10:
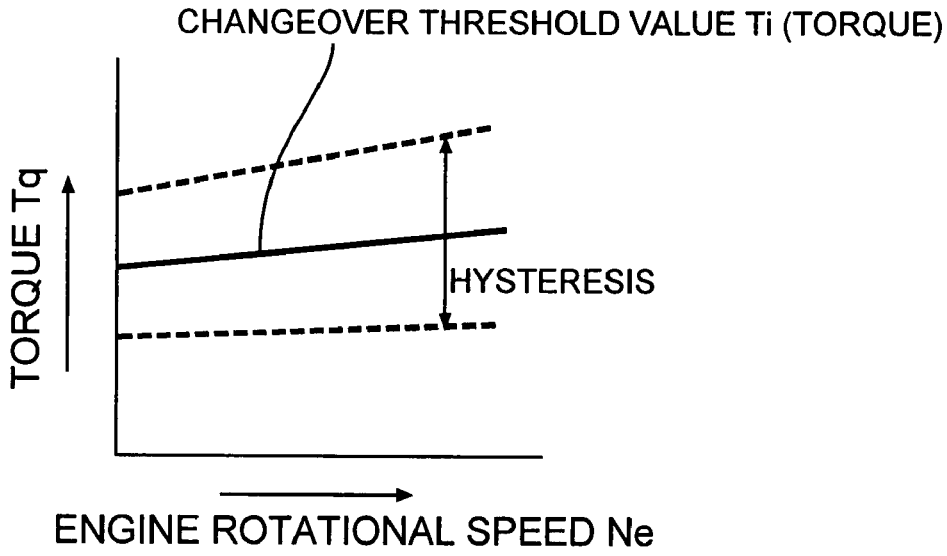
FIG. 10 is a changeover threshold value calculation map provided in an electronic control unit.

As shown in FIG. 10, according to the changeover threshold value calculation map 54, the changeover threshold value Ti is calculated based on an engine rotational speed Ne and a torque Tq. Because the changeover delay time increases as the engine rotational speed Ne increases, even when the operational condition of the engine E is determined to be in a slow acceleration or deceleration, it is desirable that a hysteresis is added to the calculated value along with the degree of slowness.

Figure 11:
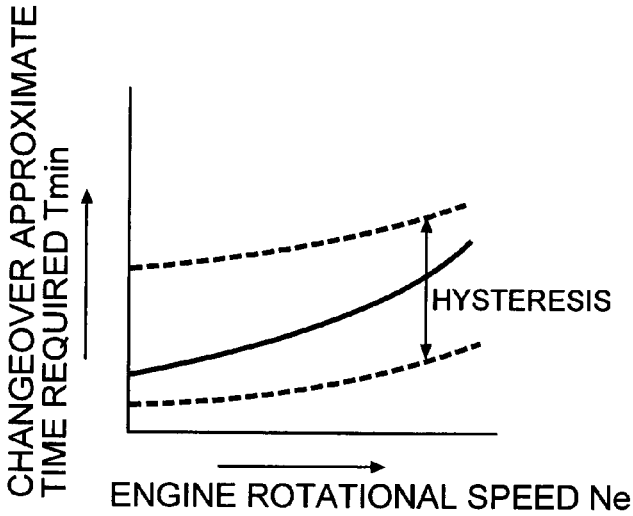
FIG. 11 is a changeover approximate time required calculation map provided in the electronic control unit.

As shown in FIG. 11, according to the changeover approximate time required calculation map 55, changeover approximate time required Tmin is calculated based on the engine rotational speed Ne. In calculating the changeover approximate time required Tmin, it is desirable to consider an engine temperature Tw. That is, when the engine is at a high temperature, the increase in the changeover approximate time required Tmin caused by the decrease in clearances between the components caused by the thermal expansion of the components of the variable compression ratio system is considered. In contrast, when the engine is at a low temperature, the decrease in the changeover approximate time required Tmin caused by the expansion of clearances between the components of the variable compression ratio system is considered.

Figure 12:
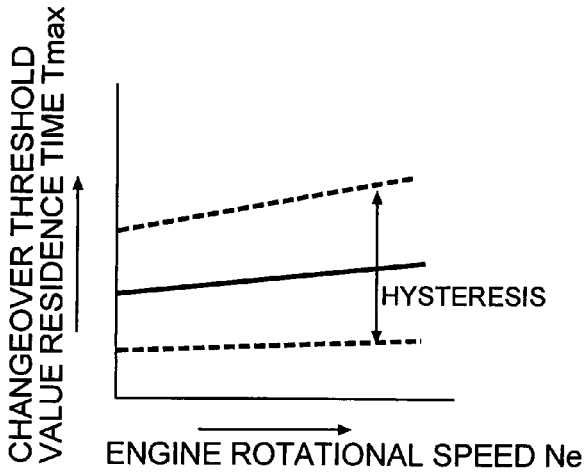
FIG. 12 is a changeover threshold value residence time calculation map provided in the electronic control unit.

As shown in FIG. 12, according to the changeover threshold value residence time calculation map 56, time Tmax for which the operational condition of the engine E resides in the vicinity of the changeover threshold value Ti is calculated likewise based on the engine rotational speed Ne.

Figure 13:
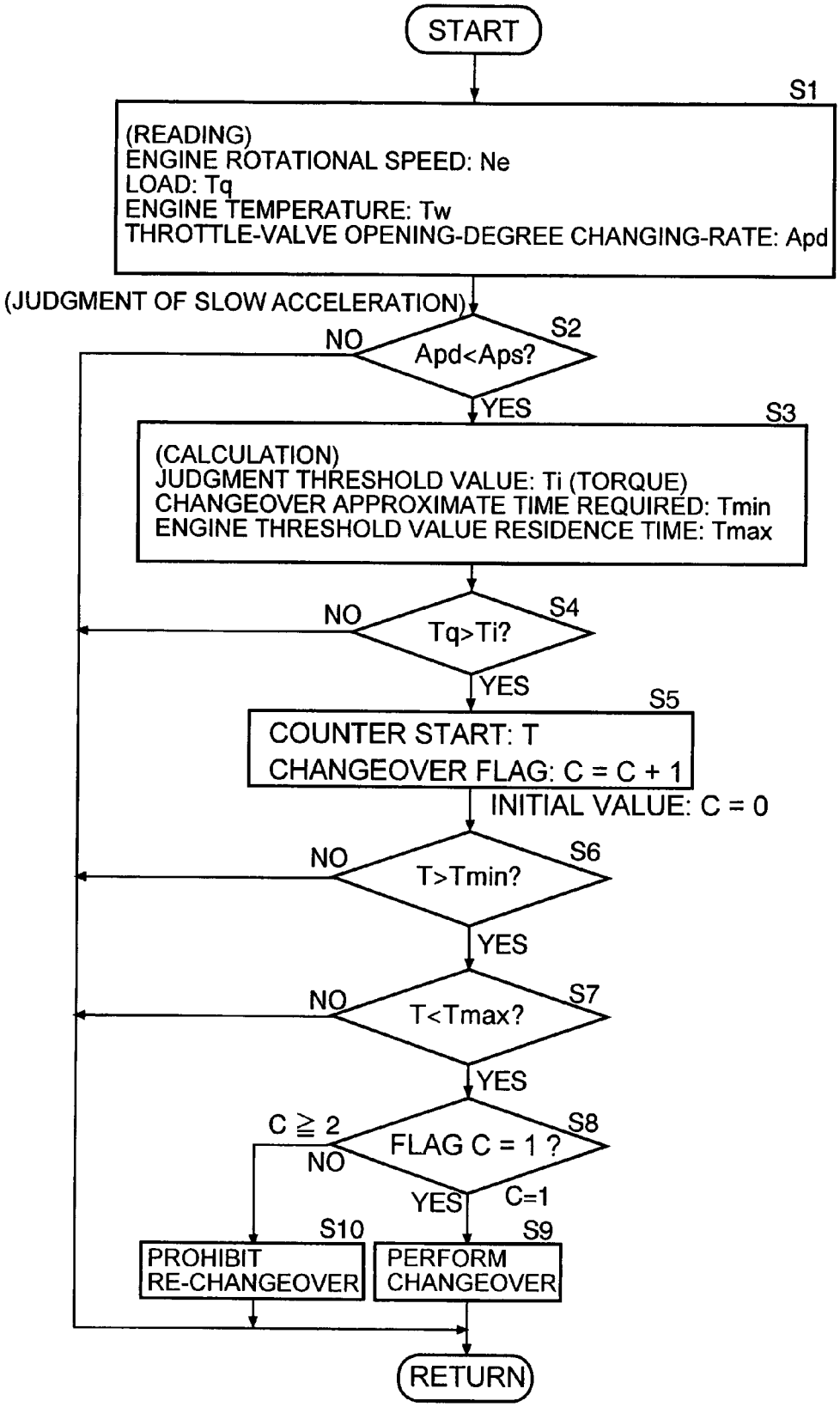
FIG. 13 is a flowchart showing a procedural sequence of a control program of the electronic control unit.
Figure 14:
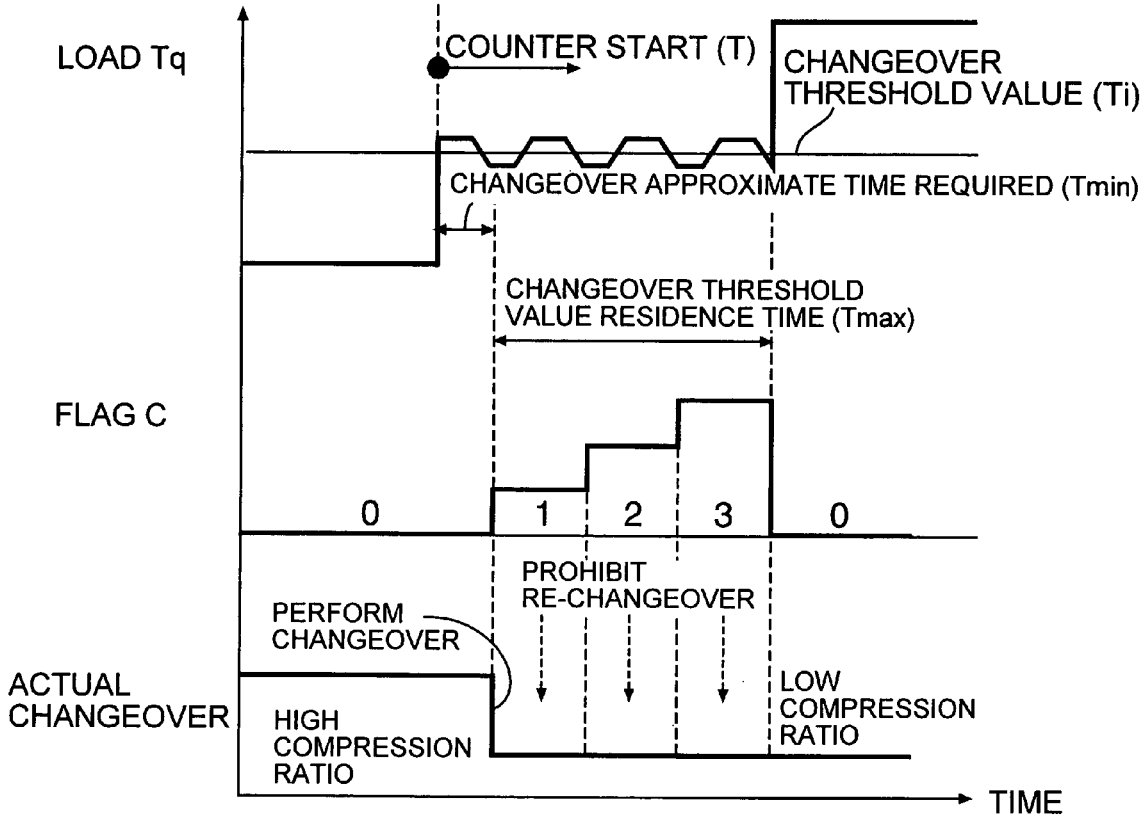
FIG. 14 is a view for explaining an operation of the electronic control unit.

Next, the procedural sequence of the control program for the electronic control unit 50 is described along the flowchart shown in FIG. 13 with reference to the operation diagram of FIG. 12.

First, in Step S1, the engine rotational speed Ne is read from the output signal of the rotational speed sensor 51; the load (torque) Tq of the engine E is read from the output signal of the throttle sensor 52, the change of throttle valve opening degree, namely, the opening degree changing rate Apd of the throttle valve per unit time is read from the output signal of the throttle sensor 52; and the engine temperature Tw is read from the output signal of the temperature sensor 53.

In Step S2, it is judged whether or not the opening degree changing rate Apd of the throttle valve is lower than a predetermined value Aps (the opening degree changing rate of the throttle valve corresponding to the upper limit value of slow acceleration or deceleration) thereby determining whether or not the engine E is in a slow acceleration or deceleration state. If the engine E is in the slow acceleration or deceleration state, the control proceeds to Step S3.

In Step S3, the changeover threshold value Ti is calculated from the changeover threshold value calculation map 54; the changeover approximate time required Tmin is calculated from the changeover approximate time required calculation map 55; and the changeover threshold value residence time Tmax is calculated from the changeover threshold value residence time calculation map 56. Thereafter, the control proceeds to Step S4.

In Step S4, it is judged whether or not the engine torque Tq at this time is larger the changeover threshold value Ti (torque). If the result is YES, the control proceeds to Step S5 assuming that the operational condition of the engine E reaches the changeover threshold value Ti.

In Step S5, the operation of the counter 57 is started immediately, and a changeover flag C is set. Thereafter, the control proceeds to Step S6.

In Step S6, it is judged whether or not the operation time T of the counter 57 is longer than the changeover approximate time required Tmin. If the judgment result is YES, the control proceeds to Step S7.

In Step S7, it is judged whether or not the operation time T of the counter 57 is shorter than the changeover threshold value residence time Tmax. If the result is YES, the control proceeds to Step S8, where it is judged whether or not the changeover flag C is 1. If C=1, a changeover signal is sent to the solenoid switch valve 45 to perform changeover of compression ratio of the engine E.

Subsequently, with the elapse of time, if it comes to be judged that C≧2 in Step S8, the control proceeds to Step S10 to prohibit the re-changeover of the compression ratio.

If it comes to be determined that the operation time of the counter 57 is longer than the changeover threshold value residence time Tmax in Step S7, the control goes to RETURN. Therefore, the prohibition of re-changeover of compression ratio is lifted.

As is apparent from the above description, according to the execution of the control program of the electronic control unit 50, in the case where the engine E enters the slow acceleration or deceleration state, and the operational condition thereof enters a state in which the operational condition of the engine E frequently crosses the changeover threshold value Ti, the compression ratio of the engine E is first changed over once. However, the re-changeover of compression ratio is thereafter prohibited in order to maintain the changed-over state for a predetermined period of time. Therefore, the compression ratio changed over first can be kept as a compression ratio best suitable for the slow acceleration or deceleration operation of the engine E. Such a changeover and holding control of compression ratio is applied to both the changeover from a high compression ratio to a low compression ratio and the changeover from a low compression ratio to a high compression ratio.

Generally, in the slow acceleration or deceleration of the engine E, the compression ratio has a strong tendency that the operational condition of engine resides in the compression ratio changed over first. This tendency is brought about by the change of the throttle valve opening degree which directly shows the traveling characteristics demanded by the driver. Therefore, the holding of the compression ratio changed over first as a compression ratio best suitable for the slow acceleration or deceleration of the engine E, as described above, conforms to the traveling characteristics demanded by the driver, thereby satisfying the drivability and further contributing to an improvement in output and a reduction in fuel consumption. Also, it is needless to say that the durability of the variable compression ratio system can be improved because changeover hunting is avoided in the system.

Also, the first changeover of compression ratio is performed after the changeover approximate time required Tmin of the variable compression ratio system has elapsed from the time when the operational condition of the internal combustion engine E reaches the changeover threshold value Ti. Therefore, the compression ratio of the engine can reliably correspond to the compression ratio of changeover command.

Further, because the predetermined time, for which the changed-over state is maintained after the first changeover of compression ratio, is set to be shorter than the residence time Tmax in the vicinity of the changeover threshold value Ti of the operational condition of the engine E, it is possible to prevent lost of the timing to change the compression ratio over to the next appropriate compression ratio.

Furthermore, calculating the residence time Tmax based on the operational condition of the internal combustion engine E brings the calculated residence time as close as possible to the actual residence time.

The present invention is not limited to the above-mentioned embodiments, and can be modified in a variety of ways without departing from the subject matter of the present invention. For example, the operating mode of the solenoid switch valve 45 can be the opposite of that of the above-mentioned embodiments. That is, an arrangement is possible in which, when the switch valve 45 is in a non-energized state, the oil passage 44 is connected to the oil pump 46, and when it is in an energized state, the oil passage 44 is connected to the oil reservoir 47. Also, the variable compression ration system of the present invention is applicable to the system disclosed in Japanese Patent Application Laid-open No. 2005-54619 as well as to the systems disclosed in Japanese Patent Application Laid-open Nos. 64-15438, 9-228858 and 60-142020.

What is claimed is:

1. An internal combustion engine variable compression ratio system, in which a compression ratio of an internal combustion engine is changed over between a high compression ratio and a low compression ratio with a changeover threshold value corresponding to a predetermined operational condition of the internal combustion engine being a boundary, wherein the system comprises means for holding a changed-over state for a predetermined period of time after a first changeover of compression ratio is performed when the internal combustion engine enters a slow acceleration or deceleration state.

2. The internal combustion engine variable compression ratio system according to claim 1, wherein the first changeover of compression ratio is performed after changeover approximate time required of the variable compression ratio system has elapsed from the time when the operational condition of the internal combustion engine reaches the changeover threshold value.

3. The internal combustion engine variable compression ratio system according to claim 2, wherein the predetermined period of time for which a changed-over state is held after the first changeover of compression ratio is performed is set to be residence time or less in the vicinity of the changeover threshold value of the operational condition of the internal combustion engine.

4. The internal combustion engine variable compression ratio system according to claim 3, wherein the residence time is calculated based on the operational condition of the internal combustion engine.

5. The variable compression ratio system for an internal combustion engine according to claim 4, wherein the changeover threshold value is set based on at least the throttle opening of the internal combustion engine.

6. The variable compression ratio system for an internal combustion engine according to claim 3, wherein the changeover threshold value is set based on at least the throttle opening of the internal combustion engine.

7. The variable compression ratio system for an internal combustion engine according to claim 2, wherein the changeover threshold value is set based on at least the throttle opening of the internal combustion engine.

8. The variable compression ratio system for an internal combustion engine according to claim 1, wherein the changeover threshold value is set based on at least the throttle opening of the internal combustion engine.

9. The internal combustion engine variable compression ratio system according to claim 1, wherein said means for holding a changed-over state including at least one cam mechanism operatively positioned between an inner piston and a piston head for controlling an axial spacing therebetween.

* * * * *